US008672130B2

(12) United States Patent
Aldridge

(10) Patent No.: US 8,672,130 B2
(45) Date of Patent: Mar. 18, 2014

(54) BLISTER PACKAGE HAVING PARTIALLY EXPOSED BLISTER TRAY

(75) Inventor: Allen Aldridge, South Orange, NJ (US)

(73) Assignee: Kraft Foods Global Brands LLC, Northfield, IL (US)

( * ) Notice: Subject to any disclaimer, the term of this patent is extended or adjusted under 35 U.S.C. 154(b) by 0 days.

(21) Appl. No.: 13/380,443

(22) PCT Filed: Jun. 23, 2010

(86) PCT No.: PCT/US2010/039653

§ 371 (c)(1),
(2), (4) Date: Mar. 12, 2012

(87) PCT Pub. No.: WO2010/151587

PCT Pub. Date: Dec. 29, 2010

(65) Prior Publication Data

US 2012/0152786 A1 Jun. 21, 2012

Related U.S. Application Data

(60) Provisional application No. 61/269,288, filed on Jun. 23, 2009.

(51) Int. Cl.
*B65D 75/36* (2006.01)

(52) U.S. Cl.
USPC ..... 206/468; 206/528

(58) Field of Classification Search
USPC ..... 206/800, 467, 468, 461, 528, 531, 532, 206/462, 469; 229/87.07
See application file for complete search history.

(56) References Cited

U.S. PATENT DOCUMENTS

| | | | | |
|---|---|---|---|---|
| 3,429,426 | A * | 2/1969 | Weller et al. | 206/531 |
| 4,192,422 | A * | 3/1980 | Kotyuk | 206/528 |
| 6,523,691 | B2 * | 2/2003 | Raj et al. | 206/538 |
| 6,776,288 | B2 * | 8/2004 | Kopecky | 206/538 |
| 7,475,783 | B2 * | 1/2009 | Geert-Jensen et al. | 206/531 |
| D592,528 | S * | 5/2009 | Short et al. | D9/730 |
| 7,735,650 | B2 * | 6/2010 | Zumbiel | 206/532 |
| 8,181,772 | B2 * | 5/2012 | Short et al. | 206/1.5 |
| 2001/0017273 | A1 * | 8/2001 | Raj et al. | 206/531 |
| 2003/0080021 | A1 * | 5/2003 | Kopecky | 206/531 |
| 2004/0256277 | A1 * | 12/2004 | Gedanke | 206/538 |
| 2007/0048414 | A1 * | 3/2007 | Glydon | 426/120 |
| 2007/0163918 | A1 * | 7/2007 | Klatt et al. | 206/531 |

(Continued)

FOREIGN PATENT DOCUMENTS

| | | | |
|---|---|---|---|
| CN | 1224399 | A | 7/1999 |
| CN | 101378975 | A | 3/2009 |

(Continued)

OTHER PUBLICATIONS

Search Report for corresponding Chinese Patent Application No. 2010800371745.

*Primary Examiner* — Steven A. Reynolds
(74) *Attorney, Agent, or Firm* — Hoffmann & Baron, LLP

(57) ABSTRACT

The present invention provides a blister package. The blister package includes a blister tray having a plurality of upwardly opening blister depressions arranged in rows and columns. The blister depressions support a consumable product. The blister sleeve is provided for receiving the blister tray. The blister sleeve is configured to expose a top portion and side edge of the blister tray and cover less than all of the blister depressions.

17 Claims, 11 Drawing Sheets

(56) References Cited

U.S. PATENT DOCUMENTS

| | | | | |
|---|---|---|---|---|
| 2008/0053858 | A1 | 3/2008 | Glydon | |
| 2008/0053863 | A1* | 3/2008 | Glydon et al. | 206/531 |
| 2008/0272020 | A1 | 11/2008 | Aldridge | |
| 2009/0008401 | A1* | 1/2009 | Short et al. | 220/826 |
| 2010/0096292 | A1* | 4/2010 | Jones | 206/531 |
| 2010/0140132 | A1* | 6/2010 | Berg et al. | 206/531 |
| 2011/0266189 | A1* | 11/2011 | Tom et al. | 206/531 |
| 2012/0160731 | A1* | 6/2012 | Aldridge et al. | 206/534 |

FOREIGN PATENT DOCUMENTS

| | | | |
|---|---|---|---|
| DE | 102007015090 | A1 | 10/2008 |
| WO | WO 91/09779 | | 7/1991 |
| WO | WO2009058979 | A1 | 5/2009 |

* cited by examiner

BLISTER PACKAGE HAVING PARTIALLY EXPOSED BLISTER TRAY

This application claims the benefit of priority to U.S. Provisional Patent Application Ser. No. 61/269,288 filed on Jun. 23, 2009, the disclosure of which is incorporated by reference herein in its entirety for all purposes.

FIELD OF THE INVENTION

The present invention relates generally to a blister package for containing and dispensing a plurality of consumable products. More particularly, the present invention relates to a blister package for dispensing gum pieces from a blister tray where portions of the blister tray are exposed from the supporting sleeve.

BACKGROUND OF THE INVENTION

There exists in the prior art numerous packages which contain consumable products such as chewing gum pieces. One type of package is a blister package which includes a blister tray and blister sleeve. Many blister packages provide both aesthetic and functional features which make the package desirable to the consumer. Certain of the desirable features include an aesthetically designed packaging which permits viewing of the contents. Certain of the functional features include the ability to retain the gum pieces in the package which allow for convenient individual dispensing of the gum pieces.

It is desirable to provide improved gum packaging which, while maintaining the aesthetically pleasing appearance, provides superior functionality to the consumer.

SUMMARY OF THE INVENTION

The present invention provides a blister package. The blister package includes a blister tray having a plurality of upwardly opening blister depressions arranged in rows and columns. The blister depressions support a consumable product. The blister sleeve is provided for receiving the blister tray. The blister sleeve is configured to expose a top portion and side edge of the blister tray and cover less than all of the blister depressions.

The present invention further provides a blister package including a blister tray having a plurality of upwardly opening blister depressions arranged in rows and columns. Each blister depression supports a consumable product therein. A sleeve has a first panel and a second panel forming a sleeve interior for receiving the blister tray. The first panel has a perimeter defining the extent of the first panel. The perimeter is configured to leave exposed at least one blister depression when the blister tray is fully inserted in the sleeve.

The present invention still further provides a blister package including a blister tray having a plurality of upwardly opening blister depressions arranged on the tray. Each blister depression supports a consumable product therein. A sleeve has a first panel and a second panel joined together by opposed first and second side walls forming a sleeve interior for receiving the blister tray. The first panel has a perimeter defining the extent of the first panel. The perimeter is configured to leave exposed at least one blister depression when the blister tray is fully inserted in the sleeve. At least one of the first and second side walls is offset from an edge of the blister tray to expose a side wall of one or more blister depression when the blister tray is fully inserted within the sleeve.

DETAILED DESCRIPTION OF THE PREFERRED EMBODIMENT

Figure 1:
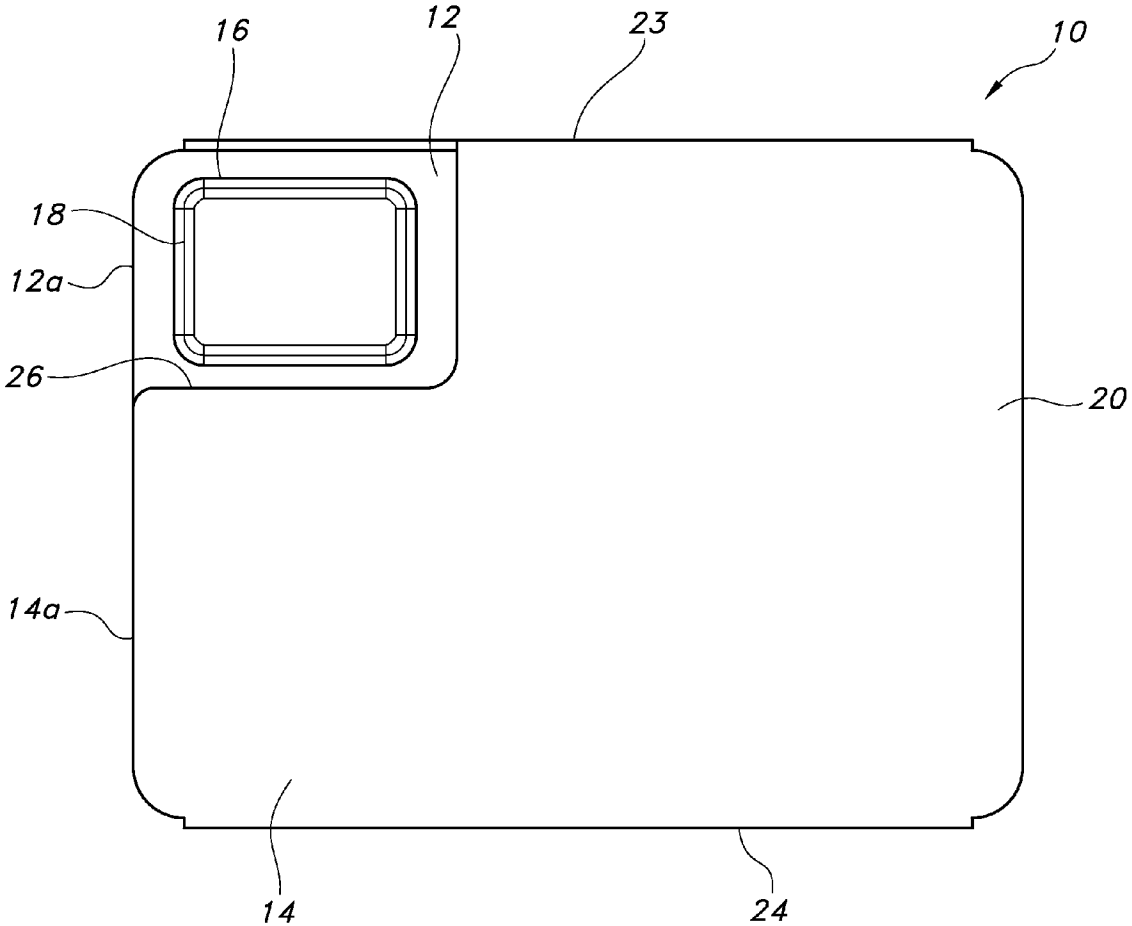
FIG. 1 is a top plan view showing packaging of the present invention having a corner removed from a sleeve to expose a portion of a blister tray, with the blister tray shown fully inserted into the sleeve.
Figure 2:
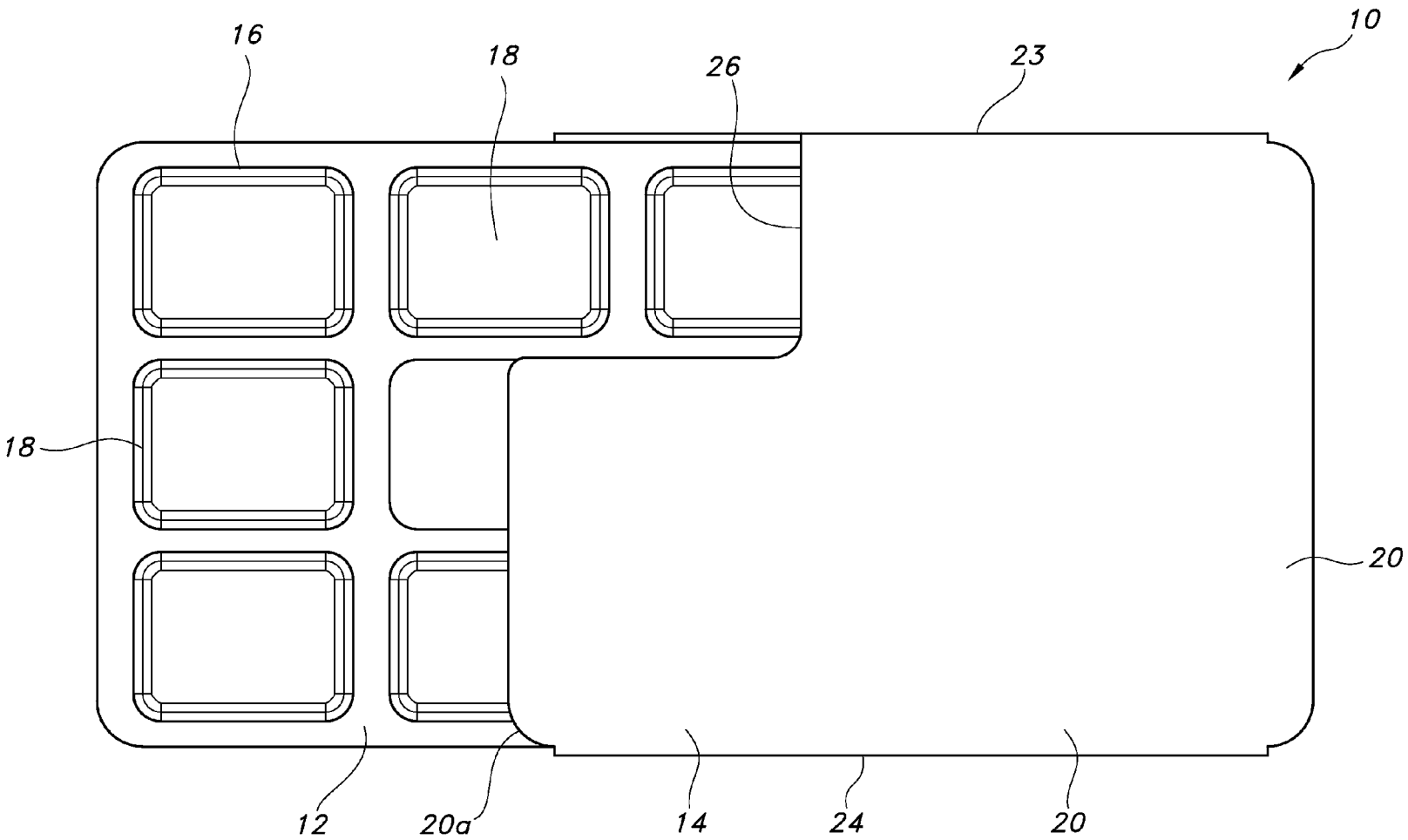
FIG. 2 is a top plan view of the packaging showing the blister tray partially removed from the sleeve.

The present invention provides a package for enclosing and dispensing a plurality of products, preferably consumable products. More particularly, the present invention is designed to contain and dispense confectionery products such as gum pellets. While gum pellets are shown in the preferred embodiments of the present invention, it may be appreciated that the package disclosed herein may be used to dispense a wide variety of consumable products such as gum pieces in one or more layers and in many forms. It is contemplated that the package of the present invention may be used to contain and dispense gum pieces in various shapes, including slabs, sticks, pellets, pillows and the like. In addition, unwrapped gum slabs are shown in the preferred embodiments herein and it is within the contemplation of the present invention that the individual gum pieces may be wrapped or unwrapped.

Referring now to FIGS. 1-3A, a first embodiment of a comestible packaging is shown. The comestible packaging may be a blister package 10 which includes a product retainer 12 in the form of a blister tray and also includes a blister sleeve 14. The blister tray 12, which is preferably formed of transparent plastic material, includes a plurality of blister depressions 16 arranged in rows and columns, each of which retains product such as a gum piece 18 therein. The tray 12 may include thereover a blister film or cover 19 to sealably enclose the pieces 18 within the blister depressions 16. The blister cover 19 may be formed of a metallic foil. Alternatively, the cover 19 may be formed of a generally transparent material such that the product retained in the depressions is viewable when looking at either side of the blister tray. In conventional fashion, the gum pieces 18 may be dispensed by pressing on the depression and forcing the gum piece past the open end of the depression and through the blister cover 19 placed thereover.

Figure 3:
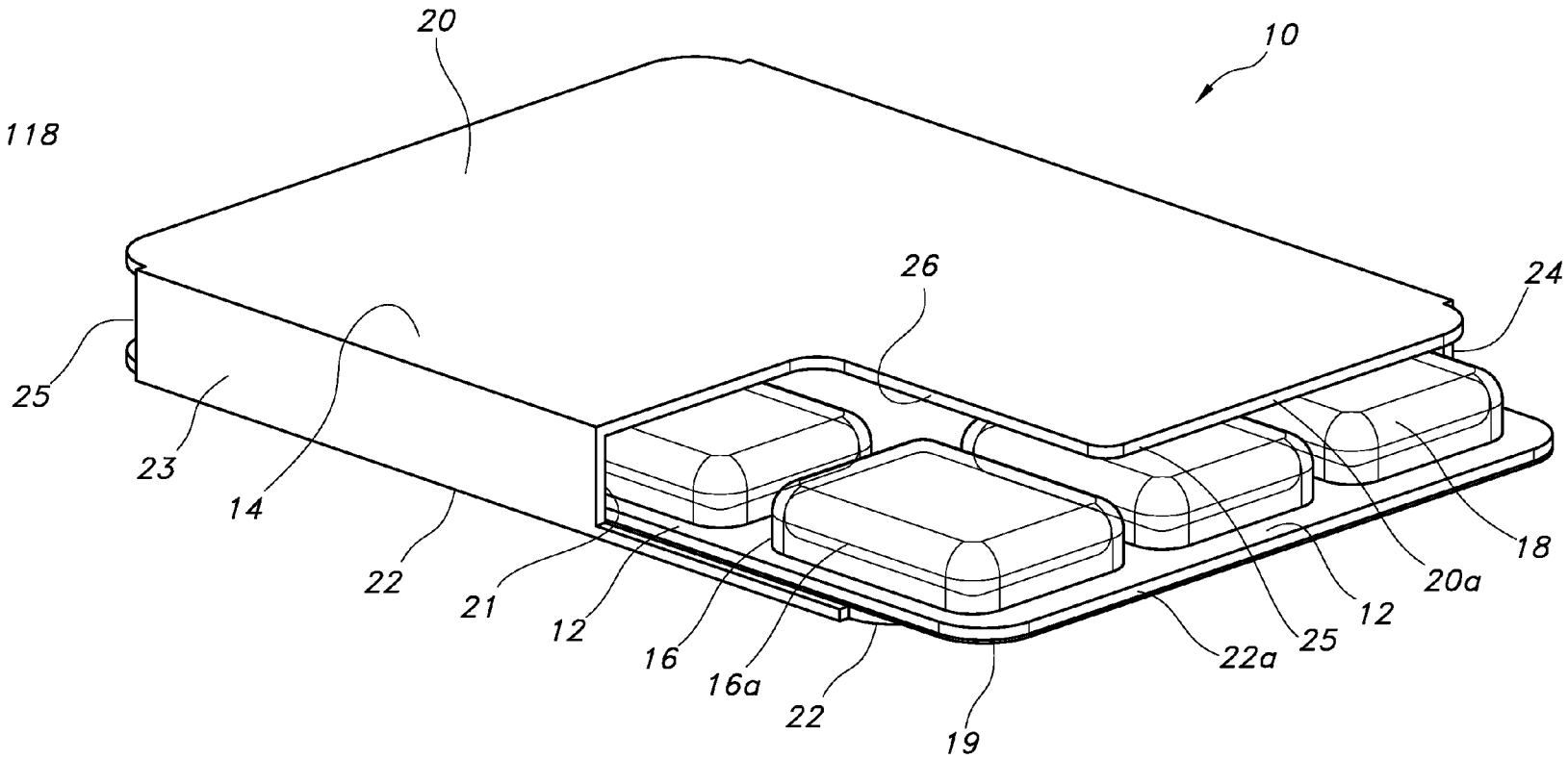
FIG. 3 is a top perspective view of the packaging.

With specific reference to FIG. 3, the blister sleeve 14 may be a generally a rectangular member having an upper and lower planar wall panels 20 and 22 which are joined by side walls 23 and 24 along opposed sides of the blister sleeve. It is within the contemplation of the present invention that the blister sleeve could have different configurations. The upper and lower panels have a perimeter 20*a* and 22*a* respectively which define the extent of the panels. The panels 20 and 22 side walls 23 and 24 form a sleeve interior 21 for receiving the blister tray 12. The remaining opposite ends 25 of the blister sleeve are open to allow slidable insertion and removal of the blister tray 12 therein. As shown in FIG. 1, the blister tray 12 may be inserted into the sleeve 14 until the leading edge 12*a* of the blister tray reaches the edge 14*a* of the sleeve at which point the blister tray 12 is fully inserted into the sleeve 14 as shown in FIG. 1.

The blister sleeve 14 having a blister tray 12 therein may be covered with a removable overwrap (not shown) to protect the contents of the package 10. A user may remove the overwrap to access the blistery tray 12 and gum pieces 18 therein.

In the upper panel 20 of blister sleeve 14, the perimeter 20*a* is configured to form a cut out 26 at a corner thereof. The cut out 26 is sized and positioned so that when the blister tray 12 is fully inserted within the blister sleeve 14, the corner blister depression 16 including the gum piece 18 supported therein is exposed and able to be viewed by the user. The configuration of the panel perimeter 20*a* forms a panel which does not overly all the blister depressions. Side wall 23 may be configured to leave exposed a side edge of the blister tray 12*b*. The side wall 23 may be offset from a blister tray edge 12*a* to expose at least a portion of the side of the blister tray when the blister tray is fully inserted in the sleeve. The offset side wall 23 leaves exposed the sides of the depressions 16*a*. This is a particularly beneficial feature where the gum pieces have aesthetic qualities such as color, shape and the like an aesthetic or ornamental configuration. In that regard, the blister tray 12 is preferably transparent to assure viewing of the gum piece.

Figure 3A:
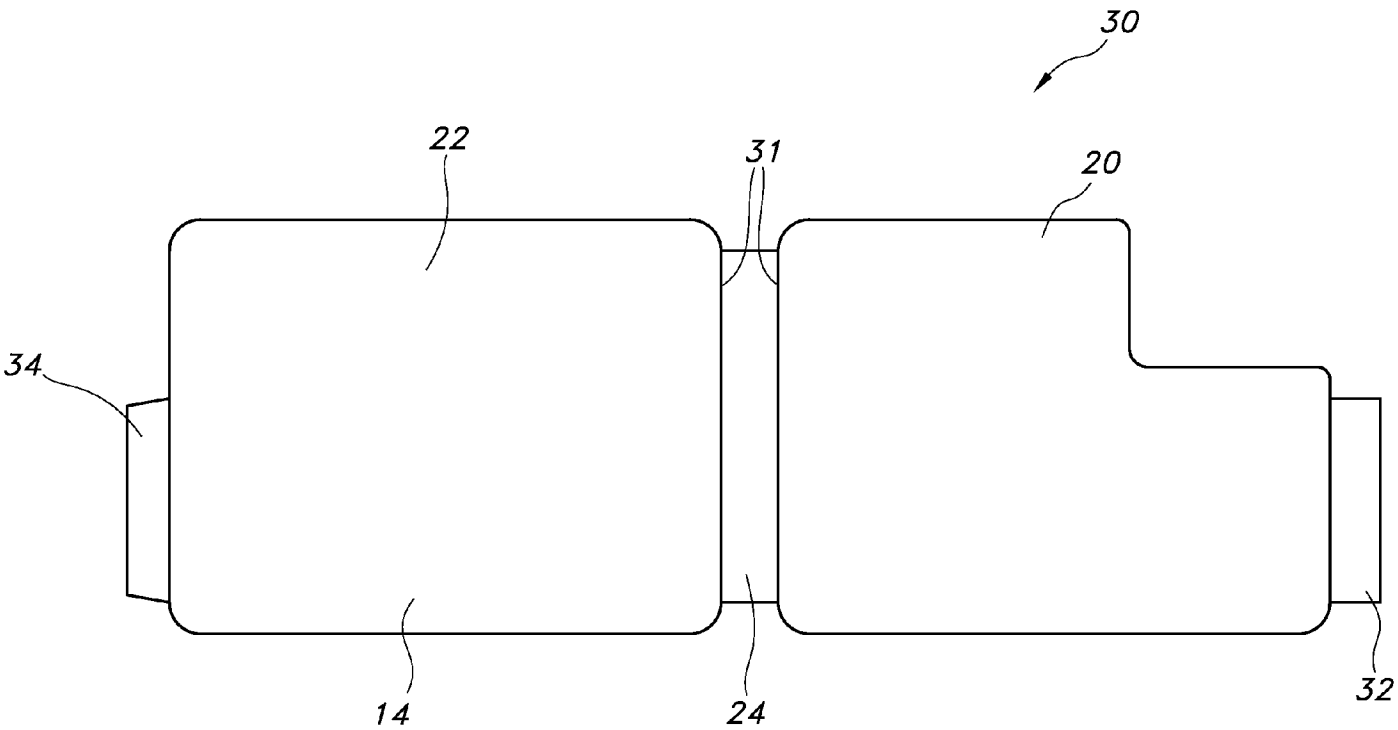
FIG. 3A is a top plan view of a blank used to form the packaging of FIG. 1.

With reference to FIG. 3A, the blister sleeve 14 may be formed from a paperboard blank 30. The blank may be folded about fold lines 31. Tabs 32 and 34 extend from panels 20 and 23 respectively and together form side wall 23. Side wall 24 is formed from the portion connecting walls 20 and 22. The blank 30 is folded such that the tabs 32 and 34 are brought into engagement and may be secured together by an adhesive to form the sleeve 14.

Figure 4:
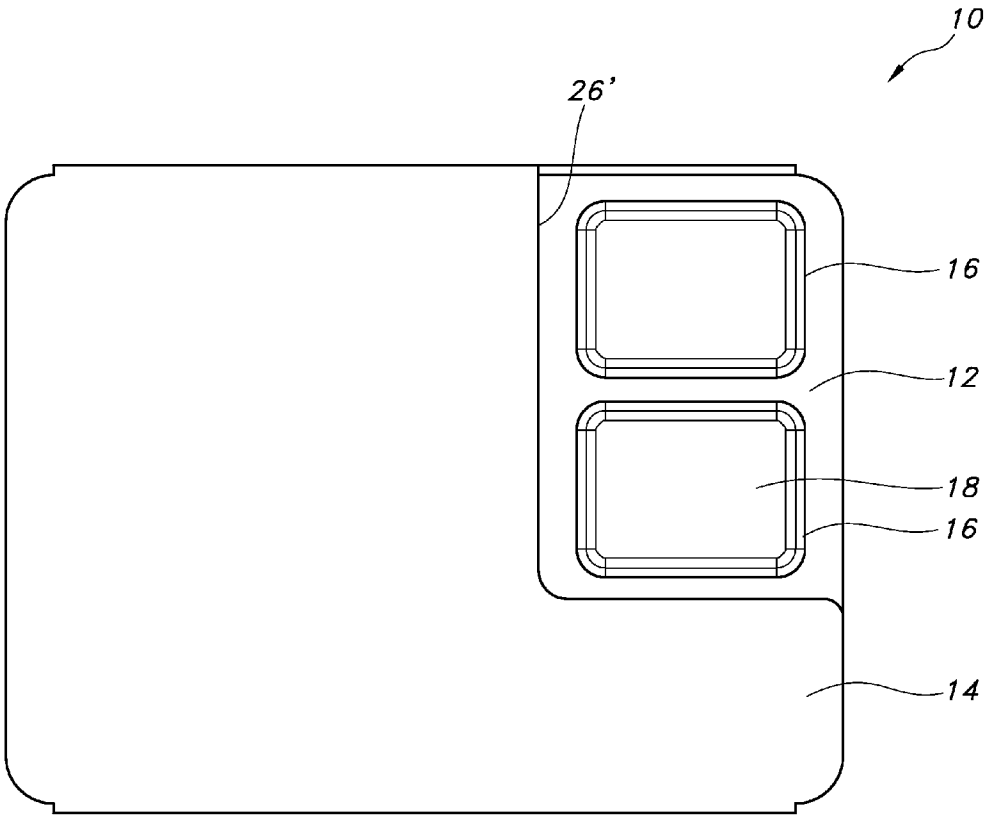
FIG. 4 is a top plan view showing an alternative embodiment of the packaging of the present invention.

The blister sleeve 14 is inserted into the blister tray 12 with the blister depressions 16 facing the cut out portion 26. While the cut out portion 26 exposes one blister depression, the perimeter 20*a* can be configured to form a cut-out portion 26 that is sized and positioned to expose more than one blister depression. For example, with respect to FIG. 4, a corner cut out 26' may be sized to expose two adjacent blister depressions 16 so that two gum pieces be viewed when the sleeve 14 accommodates the tray 12. The panel perimeter 20*a* may be configured to create a cut out uncovering a number of blister depressions.

Figure 5:
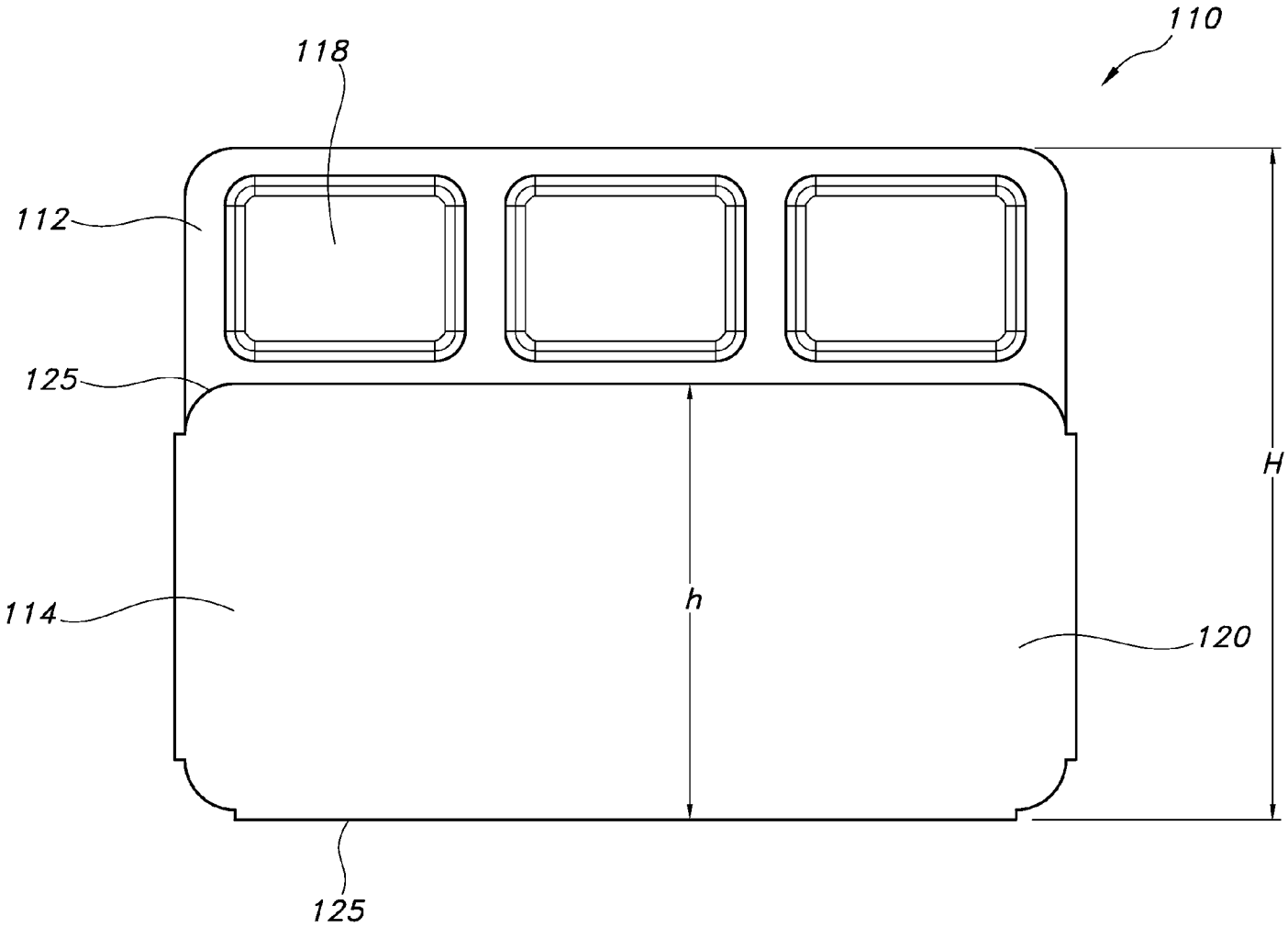
FIG. 5 is a top plan view of a further alternative embodiment of the packaging of the present invention.
Figure 5A:
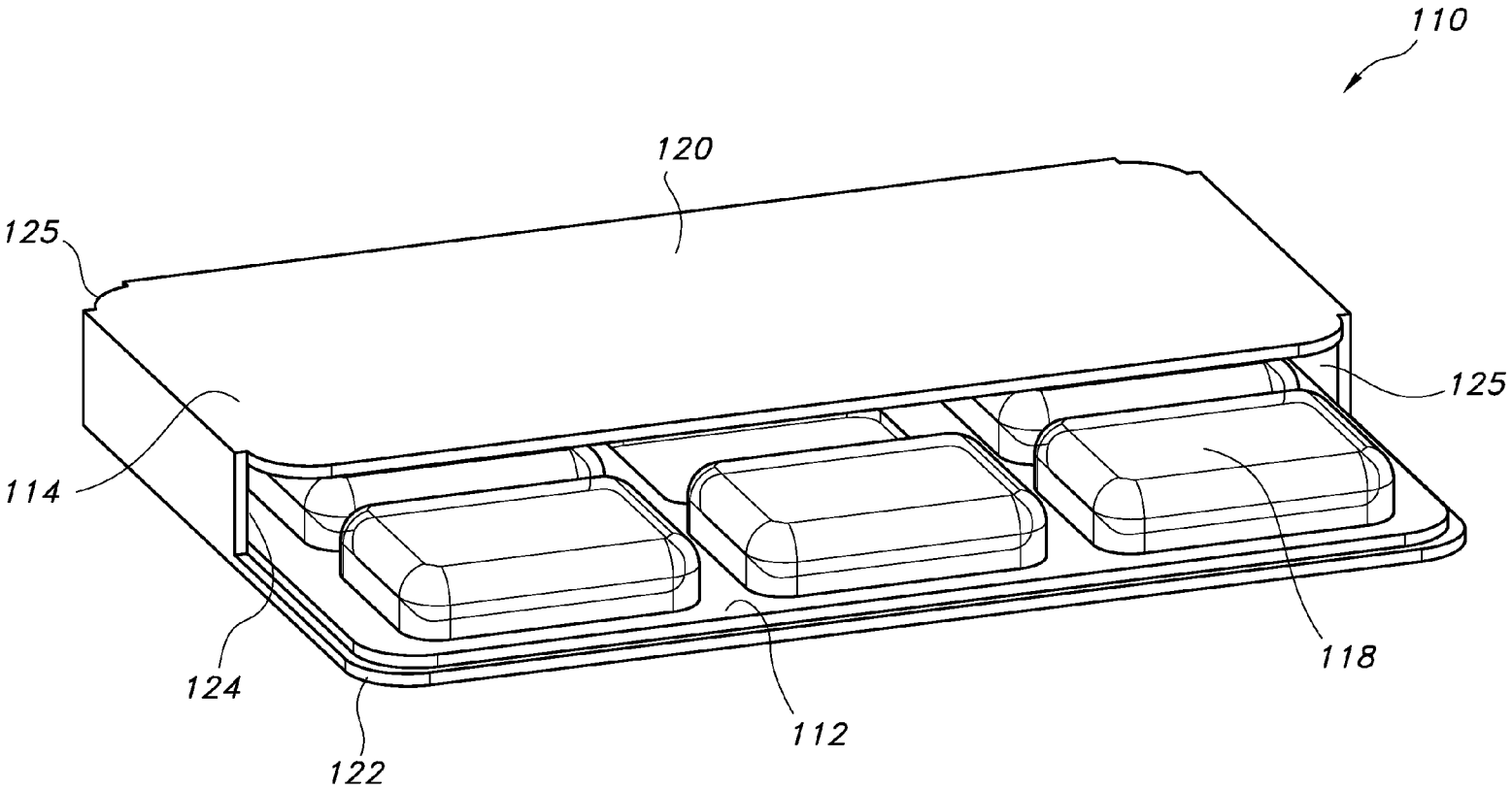
FIG. 5A is a top perspective view showing the packaging of FIG. 5.
Figure 6:
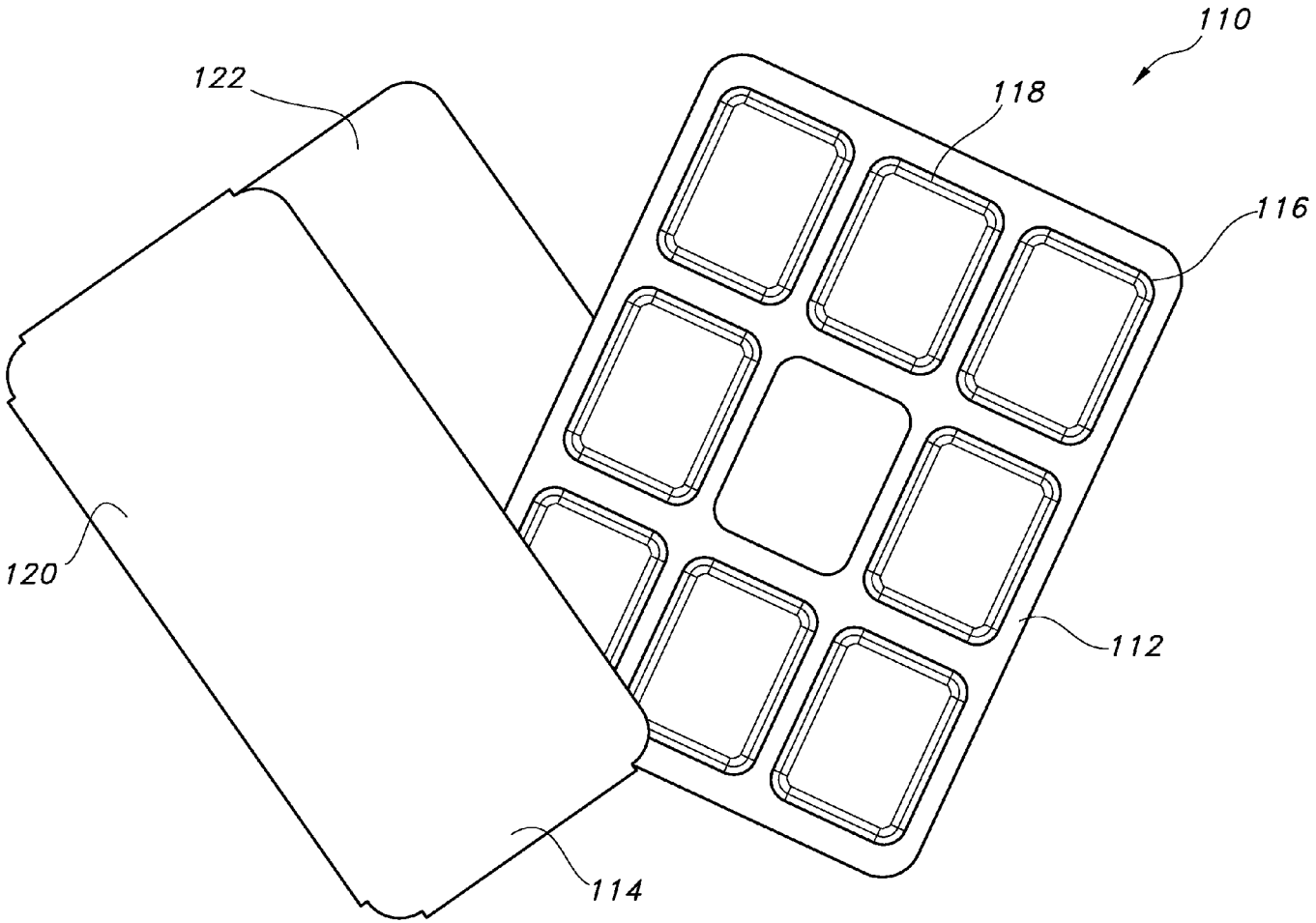
FIG. 6 is a top plan view of the packaging of FIG. 5 showing a blister tray partially removed therefrom.
Figure 7:
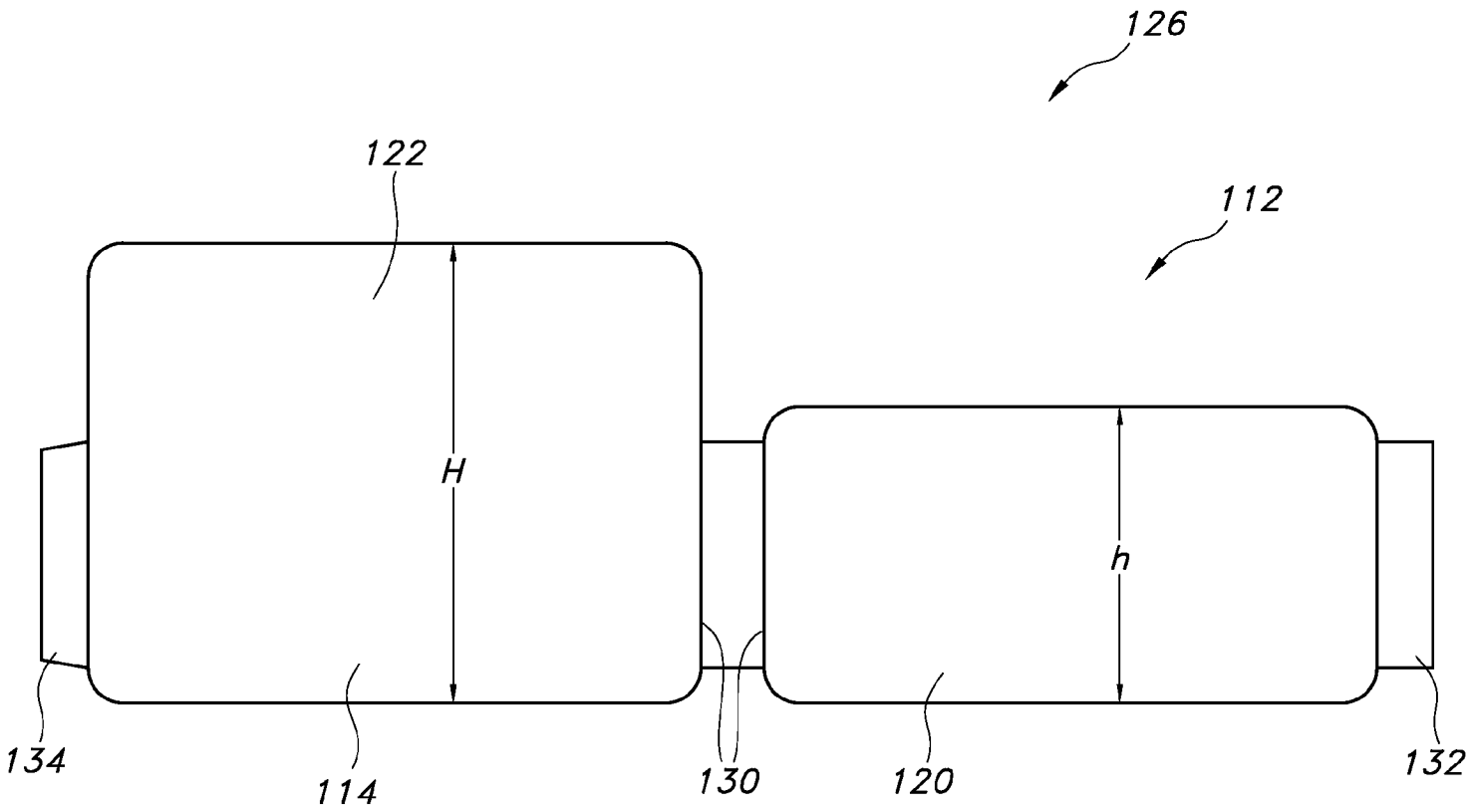
FIG. 7 is a top plan view of a blank for making a sleeve for the packaging shown in FIG. 5.

A further embodiment of the present invention is shown with respect to FIGS. 5-7. In this embodiment, a blister package 110 includes a blister tray 112 and a blister sleeve 114 which accommodates the blister tray. The blister sleeve 112 includes an upper panel 120 and a lower panel 122. The upper and lower panels define a sleeve interior 124 for receiving the blister tray 112. The sleeve interior 124 is open on both ends 125 to permit the blister tray to be slid in and out of the sleeve 112. In the present embodiment, the upper panel 120 of blister sleeve 114 has a height h, which is less than the height H of the lower panel 122 and the tray 112. Therefore, an entire row of blister depressions 116 and gum pieces 118 therein is exposed the gum pieces 118 when the tray 112 is fully positioned within the sleeve 114 as shown in FIG. 5.

With specific reference to FIG. 7, the sleeve 114 may be formed from a die cut blank 126 of paperboard or other suitable packaging material. The upper panel 120 may be folded over lower panel 128 along fold lines 130. Upon folding the blank 126, tabs 132 and 134 extending from the blank 126 are brought together and adhered to each other. Indicia may be printed on the upper and lower panels as desired, preferably before the blank 126 is folded.

Figure 8:
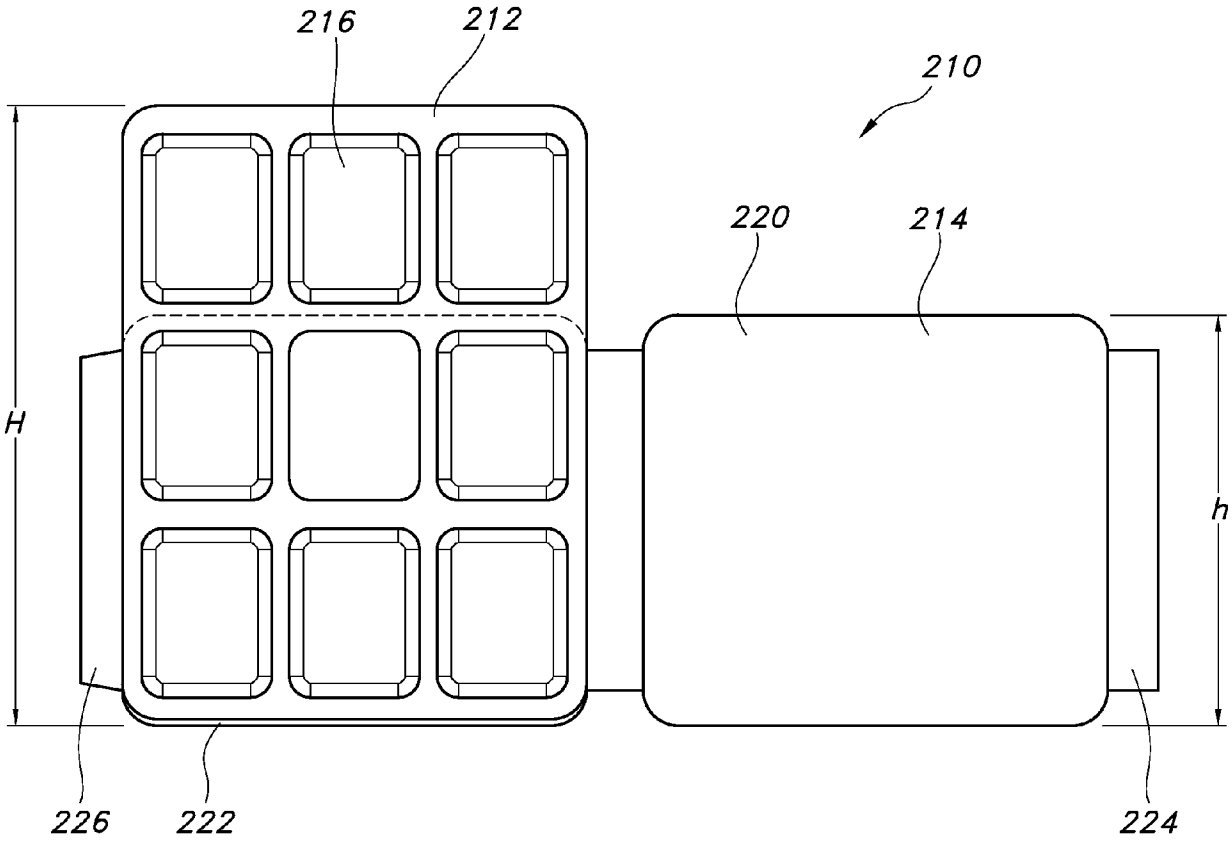
FIG. 8 is top plan view of a blister tray overlying an alternative embodiment of a blank used to form a sleeve.
Figure 9:
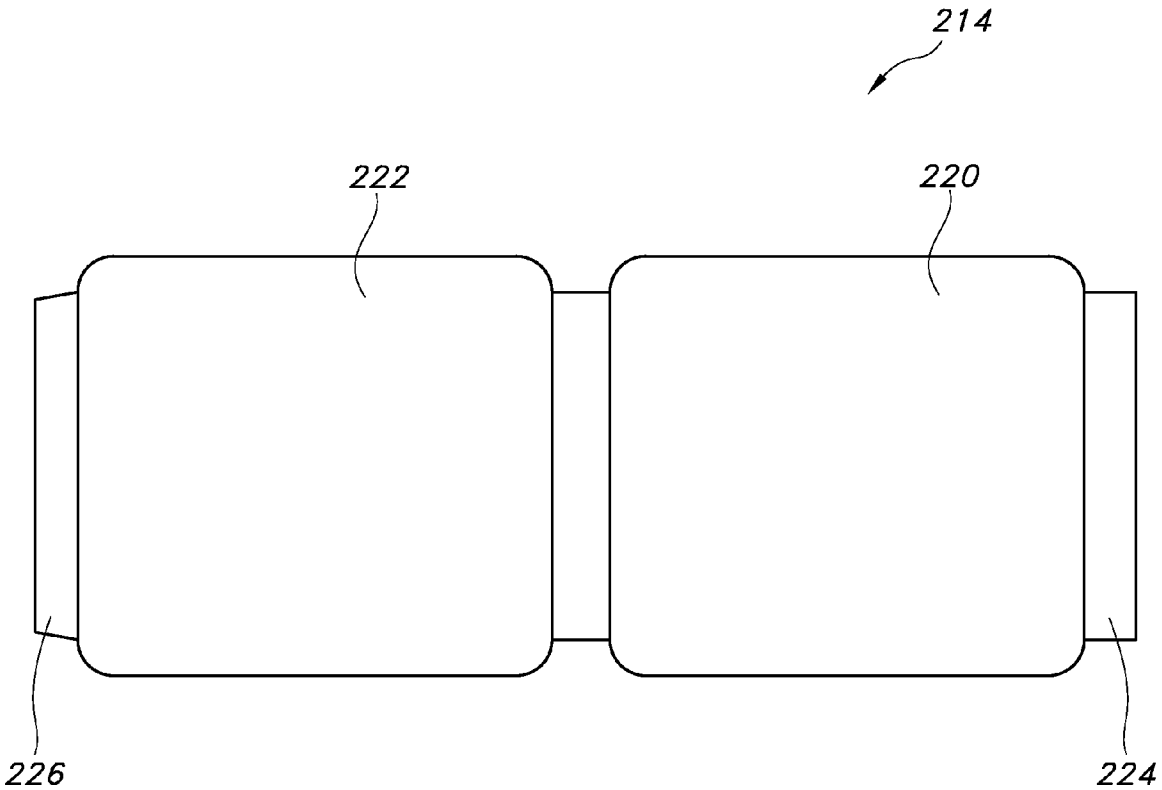
FIG. 9 is top plan view of the blank of FIG. 8.

A still further embodiment, somewhat similar to the embodiment, is shown in FIGS. 8-9. In this embodiment, the blister package 210 includes a blister tray 212 and a blister sleeve 214. The blister sleeve would be formed by folding panel 220 over panel 222 and securing side tabs 224 and 226. The opposed upper and lower walls 220 and 222 of blister sleeve 214 have the same height, h, which is less than the height, H, of the blister tray 212. Therefore when the blister tray 212 is inserted therein, one entire row of depressions 216 is exposed on both sides.

Various changes to the foregoing described and shown structures would now be evident to those skilled in the art. Accordingly, the particularly disclosed scope of the invention is set forth in the following claims.

What is claimed:

1. A blister package comprising:

a blister tray having a plurality of blister depressions arranged in rows and columns, each blister depression supporting a consumable product therein;

a blister sleeve for receiving the blister tray, the blister sleeve being configured to expose a top portion and side edge of the blister tray and cover less than all of the blister depressions; and the sleeve having a first panel and a second panel joined by a first and a second opposed side walls to form a sleeve interior for receiving the blister tray, a portion of the first and second panels including overlapping portions having planar continuous and uninterrupted surfaces covering a plurality of blister depressions when the blister tray is fully inserted in the sleeve, the first panel having a perimeter defining the extent of the first panel, the perimeter is configured to form a notch and the notch and the first side wall are configured to leave fully exposed and uncovered an upper surface and a side edge of at least one blister depression to permit viewing of the consumable product therein when the blister tray is fully inserted in the sleeve, wherein no portion of the first or second panel extends over the upper surface of the exposed blister depression when the blister tray is fully inserted in the sleeve.

2. The package as defined in claim 1, wherein the notch is sized to permit viewing a plurality of blister compartments.

3. The package as defined in claim 1, wherein the first panel has a longitudinal extent extending between the first and second side walls, and a height dimension extending generally perpendicular to the longitudinal extent, and the height of the first panel is less than a height of the blister tray wherein a plurality of blister depressions and the consumable product therein are not covered by the first panel when the blister tray is fully inserted in the sleeve.

4. The package as defined in claim 1, wherein the first panel and the second panel each have a longitudinal extent extending between the first and second side walls and a height dimension extending generally perpendicular to the longitudinal extent and the height of the first panel is less than the height of the second panel.

5. The package as defined in claim 1, wherein the second panel has a perimeter which is generally coextensive with a perimeter of the blister tray.

6. The package as defined in claim 1, wherein the blister tray has a perimeter which extends beyond the perimeter of the first panel.

7. The package as defined in claim 1, wherein the blister tray has a perimeter which extends beyond the perimeter of the first and second panels.

8. The package as defined in claim 1, wherein the first panel is generally the same size as the second panel.

9. The package as defined in claim 1, wherein the perimeter of the first panel is configured to permit viewing of one or more of the blister depressions.

10. A blister package comprising:

a blister tray having a plurality of blister depressions arranged in rows and columns, each blister depression supporting a consumable product therein; and a sleeve having a first panel and a second panel joined by a first and a second opposed side walls to form a sleeve interior for receiving the blister tray, the first panel having a perimeter defining the extent of the first panel, the perimeter and the first side wall are configured to form a notch, the notch overlying an upper surface and side surface of at least one blister depression to leave fully exposed and uncovered the at least one blister depression to permit viewing of the consumable product therein when the blister tray is fully inserted in the sleeve, and wherein the first and second panels have no portion that extends over the upper surface of the at least one blister depression when the blister tray is fully inserted in the sleeve, and wherein the first and second panels terminate in an upper edge and wherein no portion of the first and second panels extends from the upper edge of the first and second wall that is foldable over the blister tray to cover the blister.

11. The package as defined in claim 10, wherein the first panel has a height less than a height of the second panel wherein the first panel leaves a plurality of blister depressions uncovered when the blister tray is fully inserted in the sleeve.

12. The package as defined in claim 10, wherein the first panel has a height generally the same as the second panel and the blister tray extends beyond the sleeve when the blister tray is fully inserted in the sleeve.

13. The package as defined in claim 1, wherein the first and second panels terminate in an upper edge and wherein no portion of the first and second panels extends from the upper edge of the first and second panel that is foldable over the blister tray to cover the blister.

14. The package as defined in claim 3, wherein the first panel has an upper edge defining the top end of the panel extending between the opposed first and second side walls, and the upper edge along its entire length is below a row of blister depressions when the blister tray is fully inserted in the sleeve.

15. The package as defined in claim 1, wherein the first side wall has a longitudinal extent less than a longitudinal extent of the second side wall, wherein the second wall covers side surfaces of all of the blister depression and the first side wall leaves a side surface of at least one adjacent blister depression exposed when the blister tray is fully inserted in the sleeve.

16. A blister package comprising:

a blister tray having a plurality of blister depressions arranged in rows and columns, each blister depression supporting a consumable product therein;

a blister sleeve for receiving the blister tray, the blister sleeve being configured to expose a top portion and side edge of the blister tray and cover less than all of the blister depressions; and the sleeve having a first panel and a second panel joined by a first and a second opposed side walls to form a sleeve interior for receiving the blister tray, the first and second panels terminating in an upper edge and wherein no portion of the first and second panels extends from the upper edge of the first and second panel that is foldable over the blister tray to cover the blister, the first panel having a perimeter defining the extent of the first panel, the perimeter is configured to form a notch and the notch and the first side wall are configured to leave fully exposed and uncovered an upper surface and a side edge of at least one blister depression to permit viewing of the consumable product therein when the blister tray is fully inserted in the sleeve, wherein no portion of the first or second panel extends over the upper surface of the exposed blister depression when the blister tray is fully inserted in the sleeve.

17. A blister package comprising:

a blister tray having a plurality of blister depressions arranged in rows and columns, each blister depression supporting a consumable product therein;

a blister sleeve for receiving the blister tray, the blister sleeve being configured to expose a top portion and side edge of the blister tray and cover less than all of the blister depressions; and the sleeve having a first panel and a second panel joined by a first and a second opposed side walls to form a sleeve interior for receiving the blister tray, the first panel having a perimeter defining the extent of the first panel, the perimeter is configured to form a notch and the notch and the first side wall are configured to leave fully exposed and uncovered an upper surface and a side edge of at least one blister depression to permit viewing of the consumable product therein when the blister tray is fully inserted in the sleeve, wherein no portion of the first or second panel extends over the upper surface of the exposed blister depression when the blister tray is fully inserted in the sleeve, and wherein the first side wall has a longitudinal extent less than a longitudinal extent of the second side wall, wherein the second wall covers side surfaces of all of the blister depression and the first side wall leaves a side surface of at least one adjacent blister depression exposed when the blister tray is fully inserted in the sleeve.

* * * * *